United States Patent [19]

Sheffer

[11] Patent Number: 4,638,745

[45] Date of Patent: Jan. 27, 1987

[54] TELESCOPING DISPLAY STAND

[75] Inventor: Phil B. Sheffer, New Oxford, Pa.

[73] Assignee: Merchandising Innovations, Inc., Hanover, Pa.

[21] Appl. No.: 797,399

[22] Filed: Nov. 12, 1985

[51] Int. Cl.[4] ..... A47B 3/06

[52] U.S. Cl. ..... 108/111; 108/156; 108/56.3

[58] Field of Search ..... 108/111, 156, 51.3, 108/56.1, 56.3

[56] References Cited

U.S. PATENT DOCUMENTS

| | | | |
|---|---|---|---|
| 2,576,715 | 11/1951 | Farrell | 108/51.3 |
| 2,716,532 | 8/1955 | Wysong et al. | 108/51.3 |
| 3,055,624 | 9/1962 | Wilson | 108/51.3 |
| 3,877,396 | 4/1975 | Patterson | 108/111 |
| 4,050,386 | 9/1977 | Kellogg | 108/111 |
| 4,102,525 | 7/1978 | Albano | 108/51.3 |
| 4,158,336 | 6/1979 | Brescia et al. | 108/156 |

*Primary Examiner*—Francis K. Zugel

*Attorney, Agent, or Firm*—Daniel J. O'Connor

[57] ABSTRACT

A display stand, made entirely of corrugated fiberboard as the preferred material, which may be shipped with all component parts in a flat or knock-down position.

The legs of the display stand are pre-cut and pre-formed in a unique mechanical design so that they may be simply assembled using a roll-up method without the need for tools or fasteners.

Once assembled, the legs form a telescoping design whereby they may be interfitted with each other and with cooperating shelves to provide a multi-shelf display stand which, although made of light-weight materials to reduce shipping costs, is extremely sturdy in use.

9 Claims, 4 Drawing Figures

FIG. 4.
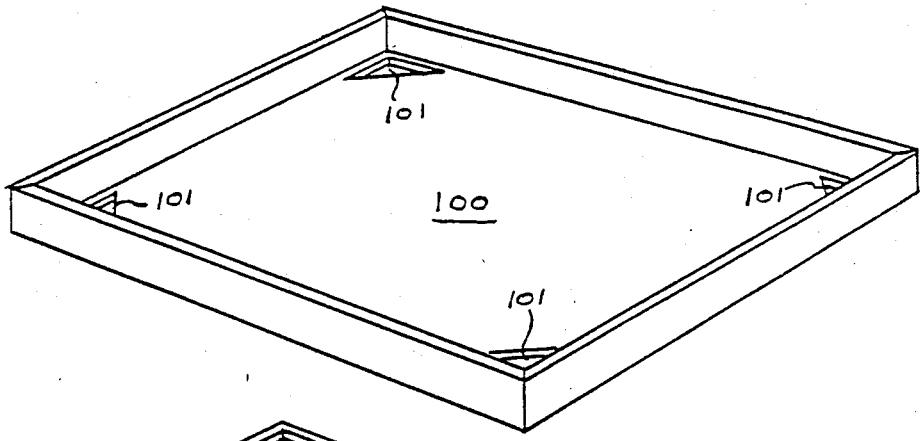
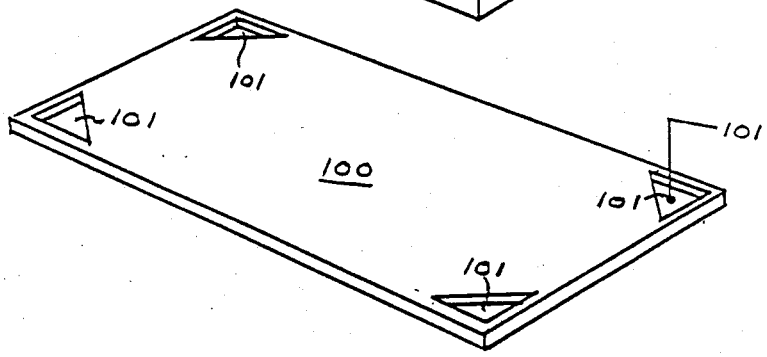
FIG. 3.

TELESCOPING DISPLAY STAND

A filing under the Disclosure Document Program of the U.S. Patent Office was previously made for the present invention.

BACKGROUND OF THE INVENTION

The widespread need for product display units is well-known in the merchandising arts.

Such display units are sometimes shipped in an assembled or partially assembled form thus requiring more shipping and warehouse space to transport and store the units. Alternatively, the display units may be shipped in an unassembled form thus requiring extensive time and labor by the retail merchant to assemble the units, thereby rendering the display units and consequently the product itself undesirable for purchase by the retailer.

Prior art display units are also known to be unstable to the extent that most must be placed on a solid table to avoid tipping over which may result in damage to the contained product or the possibility of personal injury to the store shopper.

PRIOR ART PATENTS

Three of the most relevant prior art patents related to the present invention are those issued to Patterson, U.S. Pat. No. 3,877,396; to Roveroni, U.S. Pat. No. 4,102,276; and to Michelotti, U.S. Pat. No. 4,119,045.

The Patterson patent illustrates a design with legs having slotted portions thereon for receipt of shelving units. The Roveroni patent shows formable leg members which result in a structure having corner shelf supports 16 formed therein. The Michelotti patent illustrates a knockdown shelving structure which, while easy to assemble, would be costly to manufacture and ship.

It can be appreciated from a review of the above patents that there exists a need in the art for a light weight, yet highly stable display stand which may be manufactured and shipped economically and which can be assembled without tools or complex folding procedures.

OBJECTS OF THE INVENTION

It is an object of the present invention to provide a merchandise display unit which is light-weight to reduce shipping costs.

It is also an object of the present invention to provide a display unit in which all the component parts may be shipped and stored prior to use in a flat position thereby radically reducing shipping and warehousing costs.

It is also an object to provide units which, although shipped and stored in a flat position, may be very easily and quickly assembled by the retail merchant without the need for glue or fasteners of any kind, and without the need for complex assembly procedures inherent in prior art systems.

It is a further object to provide a display unit which is durable and sturdy in both actual construction and in appearance.

It is a further object to provide a display unit capable of utilizing multiple display shelves to any desired height in which the shelves are locked or trapped in position by a unique design of interlocking vertical legs.

It is a further object of the present invention to provide units having enhanced product display functions and the capability of greatly increasing the number of units displayed in a given floor area of a retail store.

BRIEF SUMMARY OF THE INVENTION

It is contemplated that the material used in the present invention would consist of corrugated fiberboard, such material being readily available and relatively easily workable in a manufacturing sense. The unique construction of the inventor's device results in an end product display unit which is extremely durable and sturdy and yet light in weight.

While the corrugated fiberboard usage, in itself, is deemed to be highly important to the inventor, it is emphasized herein that other materials, such as plastics, woods and wood compounds, etc., may be effectively utilized in carrying out the creative principles set forth herein. Accordingly, the use of such other materials is considered to be clearly within the spirit and scope of the present invention.

Briefly, the component parts of the invention comprise display unit legs and display unit shelves.

The leg portions comprise pre-cut and pre-scored corrugated fiberboard sections utilizing known die cutting machinery. The legs, while shipped in a flat position, are cut and scored in a unique manner so that they may be readily assembled by the user thereof.

The shelf portions are pre-cut so as to be easily adaptable for use with the legs in an inter-locking and retaining fashion such that any number of desired shelves may be stacked for display purposes as desired.

As will be appreciated, the process involved in utilizing the described apparatus is also of highly significant inventive importance.

BRIEF DESCRIPTION OF THE DRAWINGS

FIG. 3 shows the flat shelf with corner apertures for receipt of the telescoping leg assemblies.

FIG. 4 shows a modification of the flat shelf of FIG. 3.

FULL DISCLOSURE OF THE PREFERRED EMBODIMENT

Figure 1:
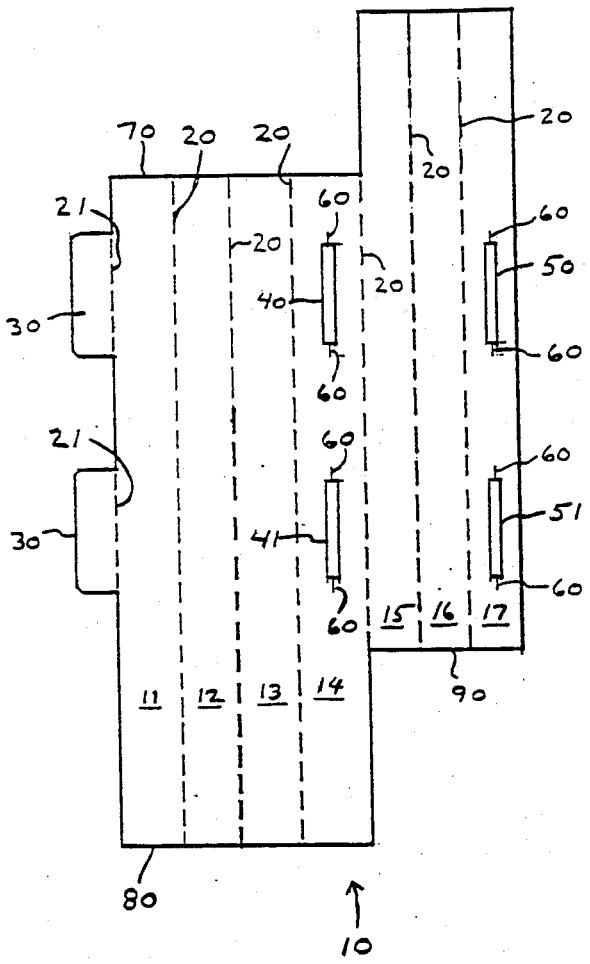
FIG. 1 shows the leg in its flat, unfolded position for shipping.

Referring now to FIG. 1, the leg portion of the display unit is shown in its flattened position for efficient shipping.

As shown, each leg 10 has a plurality of vertical scored lines 20 formed therein. The scoring lines 20 represent a machined indentation on the surface of the fiberboard which does not pierce through any layer of the fiberboard but rather represent fold lines 20 to facilitate assembly of the device.

Tabs 30 form a part of the one-piece leg assembly and also have score lines 21 at the right-hand edges thereof.

From FIG. 1, it can thus be seen that a plurality of sections are formed via the score lines 20, said sections being indicated by numerals 11, 12, 13, 14, 15, 16 and 17, respectively.

Sections 11, 12, 13 and 14 cooperate to form a first lower zone 80 of the overall leg assembly while sections 15, 16 and 17 cooperate to form a second upper zone 90 of the leg assembly. The function of said lower and upper zones, 80 and 90, will be more fully described hereinbelow.

As further shown in FIG. 1, section 14 has two slots 40 and 41 formed therein. Each of the slots 40 and 41 has small width slits 60 formed at the upper and lower ends thereof. The slotted portions 40 and 41, along with the related slits 60, serve to receive and firmly retain the tabs 30 in the folded position of the leg assembly.

Section 17 also has two slots formed therein as shown at 50 and 51. These slots also have corresponding slit elements 60. The slots and related slits in section 17 also serve to receive and firmly retain the tabs 30 when the leg assembly is in its folded position.

In order to assemble the leg from its flat position in FIG. 1, the device is simply rolled from right to left along the score lines 20. When rolled tightly, with the configuration shown, slot 40 will overlie slot 50 and slot 41 will overlie slot 51. When fully rolled, the tabs 30 will thus fit snugly into the apertures formed by slots 40, 50 and 41, 51 respectively. The snug retaining fit is achieved by the associated slits 60 as before described.

Figure 2:
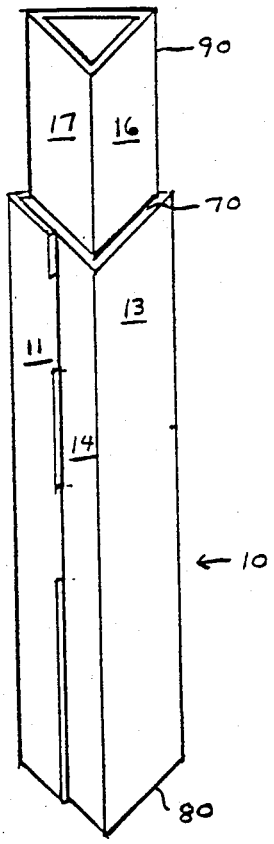
FIG. 2 shows the display unit leg in its folded position ready for use.

Thus, the folded position shown in FIG. 2 is achieved. In its folded position, the leg assembly is extremely sturdy and not bendable by any forces which would normally be encountered in the display use.

In the folded position of FIG. 2, the importance of the upper zone 90 and the lower zone 80 can be more fully appreciated. That is, a shelf or tray (shown at 100 in FIGS. 3 and 4), which has the appropriately sized corner cutout sections 101, can be placed over four of the assembled legs so that cutout sections 101 rest on the respective ledges 70 formed between lower zone 80 and upper zone 90.

Importantly, after a shelf has been placed to rest on ledge 70, a second leg, identical to that shown in FIG. 2, may be easily slid onto zone 90 so that the shelf is locked in place. This stacking of legs and shelves may continue to any desired height by the retail merchant user.

Upon reading the present application, various modifications will occur to those in the art which are within the spirit and scope of the present inventive concepts. For example, additional sections could be readily added to the flat fiberboard shown in FIG. 1 which, upon folding, would result in a four-sided leg, a five-sided leg, etc.

The telescoping feature of the present invention, accomplished by way of the easily formed zones 80 and 90, is of paramount importance to the overall device and its widespread application will be readily appreciated by those of skill in the art.

It will further be appreciated by those of skill in the art that the present invention will have widespread application in home and office environments as well as the aforementioned retail merchandising uses.

I claim:

1. A leg assembly for a telescoping display stand wherein said leg assembly comprises, a first lower zone (80), said first lower zone (80) having a plurality of sections formed therein via vertical score lines (20), at least one tab (30) formed on an outer section (11) of said first lower zone, wherein one of the sections of said first lower zone (80) has at least one slot (40) formed therein, said slot (40) being formed at the same level as said tab (30), a second upper zone (90) attached to said first lower zone (80) via a vertical score line (20), said second upper zone (90) extending substantially above said first lower zone (80), said second upper zone (90) having a plurality of sections formed therein via vertical score lines (20), wherein one of the sections of said second upper zone (90) has at least one slot (50) formed therein, said slot (50) being formed at the same level as said tab (30) and said slot (40), means for manually rolling said leg assembly along said vertical score lines (20) such that said at least one slot (40) in said first lower zone (80) overlies said at least one slot (50) in said second upper zone (90), means whereby said plurality of sections are formed such that said at least one tab (30) may be inserted into said slots (40, 50) to thereby retain the leg in a locked position ready for use, means whereby upon being in said locked position a ledge (70) is formed between said first lower zone (80) and said second upper zone (90), said ledge (70) being formed around the entire periphery of said leg assembly when in its locked position, wherein said leg assembly is comprised entirely of corrugated fiberboard material and requires no separate fastener elements, wherein said plurality of sections of said second upper zone (90) are of reduced width relative to said plurality of sections in said first lower zone (80) to provide means whereby said second upper zone, upon assembly, may be slidably and securely received into a first lower zone of another identical leg assembly, wherein said second upper zone (90) is positioned laterally of said first lower zone (80) when said leg assembly is in its flattened position.

2. The leg assembly of claim 1 wherein said first lower zone (80) has first (11), second (12), third (13) and fourth (14) sections formed thereon via said vertical score lines (20).

3. The leg assembly of claim 2 wherein said first section (11) has two tabs (30) formed on a side thereof via vertical score lines (21).

4. The leg assembly of claim 3 in which said fourth section (14) has two vertical slots (40, 41) formed therein at a level corresponding to the level of said two tabs (30).

5. The leg assembly of claim 4 wherein said second upper zone (90) has first (15), second (16) and third (17) sections formed thereon via vertical score lines (20).

6. The leg assembly of claim 5 wherein said third section (17) of said second upper zone (90) has two vertical slots (50,51) formed therein at a level corresponding to the level of said two tabs (30) and said vertical slots (40,41) formed in the fourth section (14) of said first lower zone (80).

7. The apparatus of claim 1 wherein said leg assembly is formed of a precut and prescored corrugated fiberboard material.

8. The leg assembly of claim 6 wherein each of said vertical slots (40,50) has slits (60) formed on the edges thereof for secure retention of said tabs (30) in said slots.

9. The leg assembly of claim 1 wherein, upon assembly, the lower part of said second upper zone (90) is contained within said first lower zone (80) to thereby result in a durable leg assembly.

* * * * *